US006932208B1

(12) United States Patent
Wen

(10) Patent No.: US 6,932,208 B1
(45) Date of Patent: Aug. 23, 2005

(54) AVOIDING BILL BEING EXTRACTED APPARATUS

(75) Inventor: Yaw-Hoing Wen, Taipei Hsien (TW)

(73) Assignee: International Games System Co., Ltd., Taipei Hsien (TW)

( * ) Notice: Subject to any disclaimer, the term of this patent is extended or adjusted under 35 U.S.C. 154(b) by 0 days.

(21) Appl. No.: 10/993,828

(22) Filed: Nov. 19, 2004

(30) Foreign Application Priority Data

Sep. 21, 2004 (TW) ..... 93128618 A

(51) Int. Cl.[7] ..... G07D 11/00
(52) U.S. Cl. ..... 194/203
(58) Field of Search ..... 194/202, 203; 271/273; 221/247

(56) References Cited

U.S. PATENT DOCUMENTS 5,259,490 A * 11/1993 Gardellini ..... 194/203
5,577,589 A * 11/1996 Garcia Tinoco ..... 194/204
5,806,649 A * 9/1998 Walsh et al. ..... 194/203
6,179,110 B1 * 1/2001 Ohkawa et al. ..... 194/203
6,668,998 B1 * 12/2003 Mosteller et al. ..... 194/203

* cited by examiner

*Primary Examiner*—Donald P. Walsh
*Assistant Examiner*—Mark Beauchaine
(74) *Attorney, Agent, or Firm*—Thomas, Kayden, Horstemeyer & Risley

(57) ABSTRACT

The present invention describes an apparatus for preventing extraction of a bill from a money exchange machine. This apparatus uses a main roller, an auxiliary roller, two supporters, a lead board and a protection board. The two ends of both the main roller and the auxiliary roller are set in the two supporters for rotation. The main roller and the auxiliary roller rotate in opposite directions and a channel exists between them. The main roller is made of a plurality of round boards. A bump is extends from part of the surface of each round board. A lead board is located behind the main roller. A channel is formed between the main roller and the lead board.

6 Claims, 4 Drawing Sheets

AVOIDING BILL BEING EXTRACTED APPARATUS

RELATED APPLICATIONS

The present application is based on, and claims priority from, Taiwan Application Serial Number 93128618, filed on Sep. 21, 2004, the disclosure of which is hereby incorporated by reference herein in its entirety.

FIELD OF THE INVENTION

The present invention relates to an extracted avoiding apparatus, and more particularly, to an apparatus for avoiding bill being extracted.

BACKGROUND OF THE INVENTION

Today, much work is performed by automatic machines, such as an automatic sales machine, to offset the increase in manpower costs. Initially, the automatic sales machine only received coins. Characteristics of a coin, such as, for example, volume, density, and electric conductivity, are used to determine whether the coins are real or counterfeit. However, when the paper money with high face value is commonly used, such sales machines must receive paper money.

Typically, a money exchange apparatus is installed in an automatic sales machine for receiving paper money. When the paper money is inserted into the entrance and blocks a light set in the entrance, a main roller is triggered to bring the paper money into the money exchange apparatus. An optical detection apparatus is also triggered to detect the paper money for determining whether the paper money is real or counterfeit. Each optical detection apparatus includes some light-emitting diodes (LEDs) that emit infrared rays and visible light with different wavelengths and photodiodes for receiving the emitted light from LEDs. These LEDs and photodiodes are used to detect the characteristics of the paper money, such as the reflection ratio, transmission ratio and fluorescent color, for determining whether the money is real or counterfeit and the face value of the paper money.

The main object of using an automatic sales machine is for reducing manpower costs and to allow off-hour business. However, the inserted paper money is often extracted from the money exchange apparatus by a criminal using a special tool in off-hours. Therefore, preventing extraction of paper is very important.

FIG. 1 is a schematic, three-dimensional diagram of a conventional money exchange apparatus with paper money inserted therein. First, the paper money 100 is sent to the entrance and through the trail 102 into the money exchange apparatus. Then, a curved trail 104 is used to lead the paper money 100 to prevent extraction of the paper money 100. An optical detecting apparatus 106 connected to the curved trail 104 detects the veracity of the paper money 100. Real paper money 100 is sent to the storage box 108, and counterfeit paper money 100 is sent out of the money exchange apparatus through another route (not shown in this figure) or through the original route.

Typically, the curved trail 104 is used to avoid extraction of the paper money 100. However, this kind of protection is easily circumvented. For example, a criminal may first adhere a line to a real bill. A counterfeit bill is inserted into the money exchange apparatus after inserting the real bill. Then, the real bill may be extracted from the money exchange apparatus by this line immediately when the counterfeit bill is rejected by the money exchange apparatus. Therefore, although the counter in the money exchange apparatus counts receipt of a bill, the bill has actually been extracted by the criminal. At this time, if the criminal asks money exchange apparatus to return this sum of money, money from the storage box is returned to the criminal, resulting in a business loss. Therefore, a design that can completely prevent loss is required.

SUMMARY OF THE INVENTION

The main purpose of the present invention is to provide an apparatus that prevents extraction of a bill from a bill receiving apparatus.

Another purpose of the present invention is to provide an apparatus that prevents extraction of a bill by a line. This apparatus winds up the line adhered to the paper money sent into a money exchange apparatus to prevent extraction of this bill.

According to the above purposes of the present invention, an apparatus for preventing extraction of a bill of paper money is provided. This apparatus includes a main roller, an auxiliary roller, two supporters, a lead board and a protection board. The two ends of both the main roller and the auxiliary roller are set in the two supporters to rotate. The rotating directions of the main roller and the auxiliary roller are exactly opposite. A channel is formed between the main roller and the auxiliary roller. The main roller is composed of a plurality of round boards. A bump extends from a partial surface of each round board. The extended bump winds up a line adhered to an inserted bill. The lead board is located behind the main roller. A channel is formed between the main roller and the lead board.

When a bill of paper money enters the apparatus of the present invention, the rotation of the main roller leads this paper money into the channel between the main roller and the lead board. Following this channel, this paper money is brought to the channel between the main roller and the auxiliary roller. Then, the paper money may be sent out from the extraction prevention apparatus by the opposite rotation of the main roller and the auxiliary roller.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 2A:
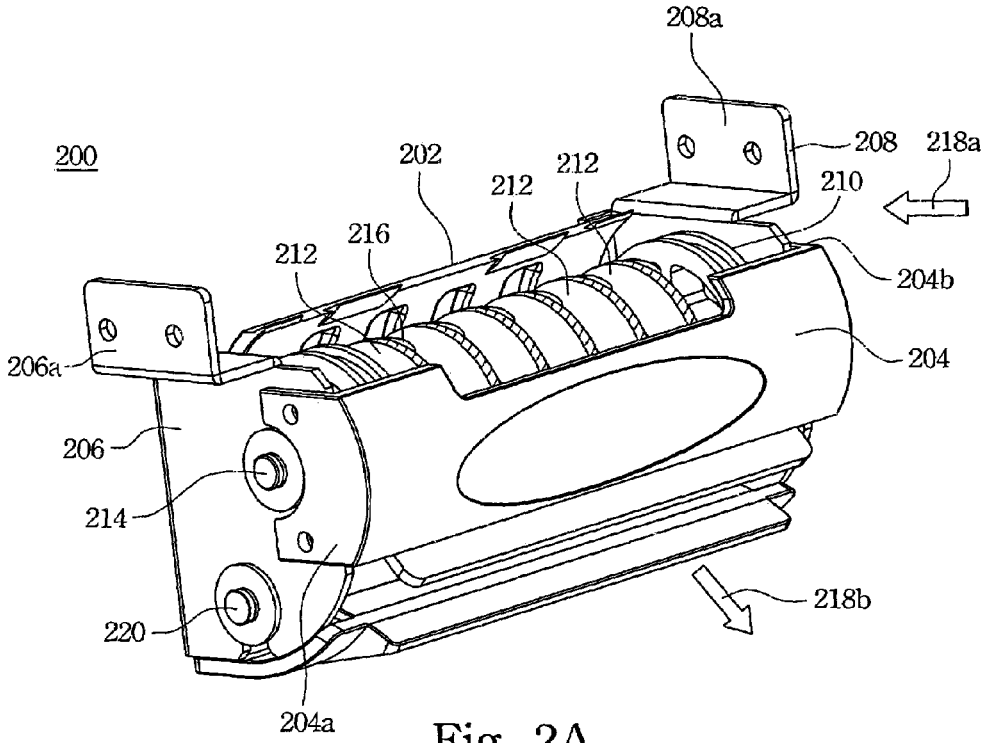
FIG. 2A to FIG. 2C illustrates an extraction prevention apparatus according to the preferred embodiment of the present invention.

FIG. 2A illustrates a structure of an extraction prevention apparatus 200 according to the preferred embodiment of the present invention. This apparatus 200 includes a main roller 210, an auxiliary roller 220, two supporters 206 and 208, a lead board 202 and a protection board 204.

The main roller 210 is composed of an axle 214 and a plurality of round boards 212. The axle 214 passes through the centers of these round boards. The two ends of axle 214 are supported by the two supporters 206 and 208, respectively. This main roller 210 may rotate according to the axle 214.

Figure 3:
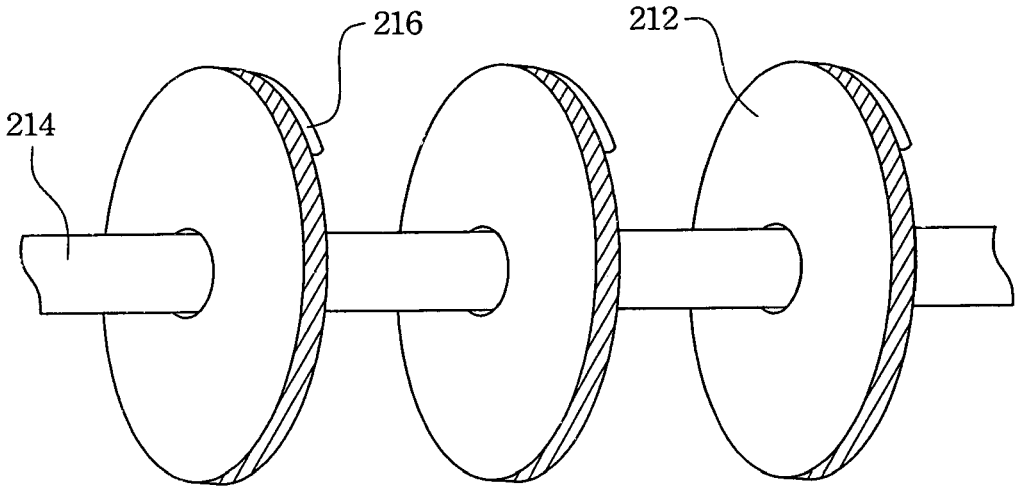
FIG. 3 is an enlarged diagram of a main roller of the present invention.

FIG. 3 is an enlarged diagram of a main roller 210 of the present invention. According to this present invention, an axle 214 passes through the center of each round board 212 and causes this round board 212 to rotate. In other words, the axle 214 is the common rotation axle of these round boards 212. A bump 216 extends from a partial surface of each round board 212. The extended bump 216 winds up a line adhered to inserted bills.

Referring to FIG. 2A again, the lead board 202 has a sharp arc and is located behind the main roller 210. A channel is formed between the main roller 210 and the lead board 202. The main object of the lead board 202 is to lead the paper money into the channel formed between the main roller 210 and the lead board 202 when the main roller is rotating to bring in the bill. The lead board 202 may be an independent board. The lead board 202 may be adhered to the two supporters 206 and 208 by an adhering means. Additionally, the lead board 202 and the supporters 206 and 208 may be cast in the same mold.

A protection board 204 is also located behind the main roller 210. Typically, the protection board 204 and the lead board 202 are not located on the same side of the main roller 210. The main function of the protection board 204 is to prevent foreign matter entering and breaking the main roller 210 when the main roller 210 is rotating. According to the preferred embodiment of the present invention, the protection board 204 has a reversed "U"-shape. The protection board 204 may be adhered to the two supporters 206 and 208 by an adhering means.

Figure 2B:
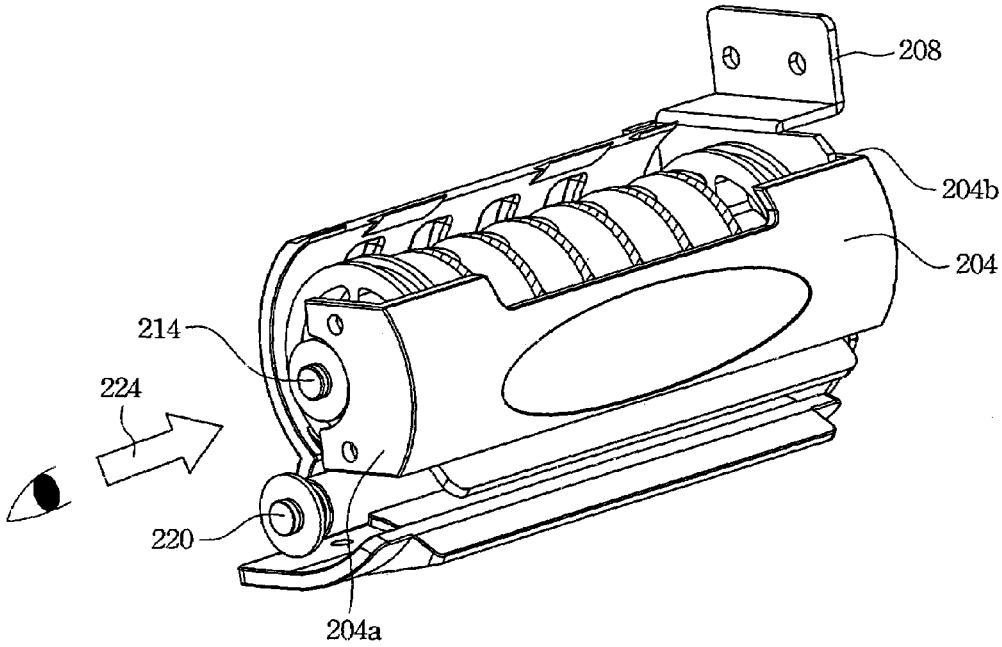

FIG. 2B is a schematic diagram of the extracted avoiding apparatus after removing the supporter 206. The protection board 204 has two side boards 204*a* and 204*b*. A fillister 222 with a semi-circular shape is formed in each side board for locating the axle 214.

Referring to FIG. 2A again, the auxiliary roller 220 is strip shaped and located under the lead board 202. The two ends of the auxiliary roller 220 are set in the supporter 206 and 208, respectively. The rotating directions of the main roller 210 and the auxiliary roller 220 are exactly opposite. Therefore, the bill may be sent out from the extraction prevention apparatus 200 by the opposite rotation of the main roller 212 and the auxiliary roller 220.

Figure 2C:
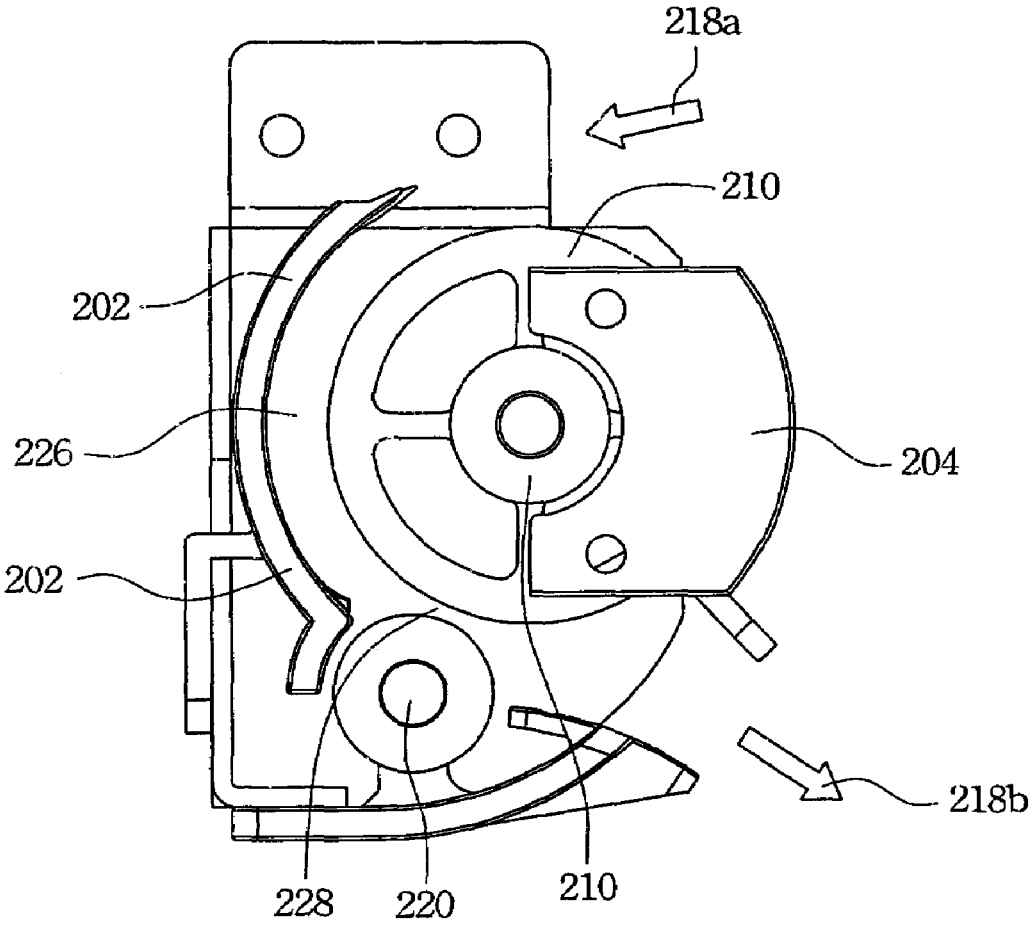

FIG. 2C is a side view from the arrow 224 in the FIG. 2B. When the bill is sent into the extraction prevention apparatus 200 of the present invention following the arrow 218*a*, the rotation of the main roller 212 leads the bill into channel 226 between the main roller 212 and the lead board 202. Following channel 226, the bill is brought to the channel 228 between the main roller 212 and the auxiliary roller 220. Then, the bill is sent out from the extraction prevention apparatus 200 following the arrow 218*b* by the opposite rotation of the main roller 212 and the auxiliary roller 220.

Referring to FIG. 2C and FIG. 3 again, a bump 216 extends from part of the surface of each round board 212. Therefore, when a bill with a line is sent into the apparatus 200 and passes through the channels 226 and 228, the line is wound by the bump. Additionally, the extended bump resists this line being removed from the axle 214 and forces the line to be wound in around the axle 214.

Figure 1:
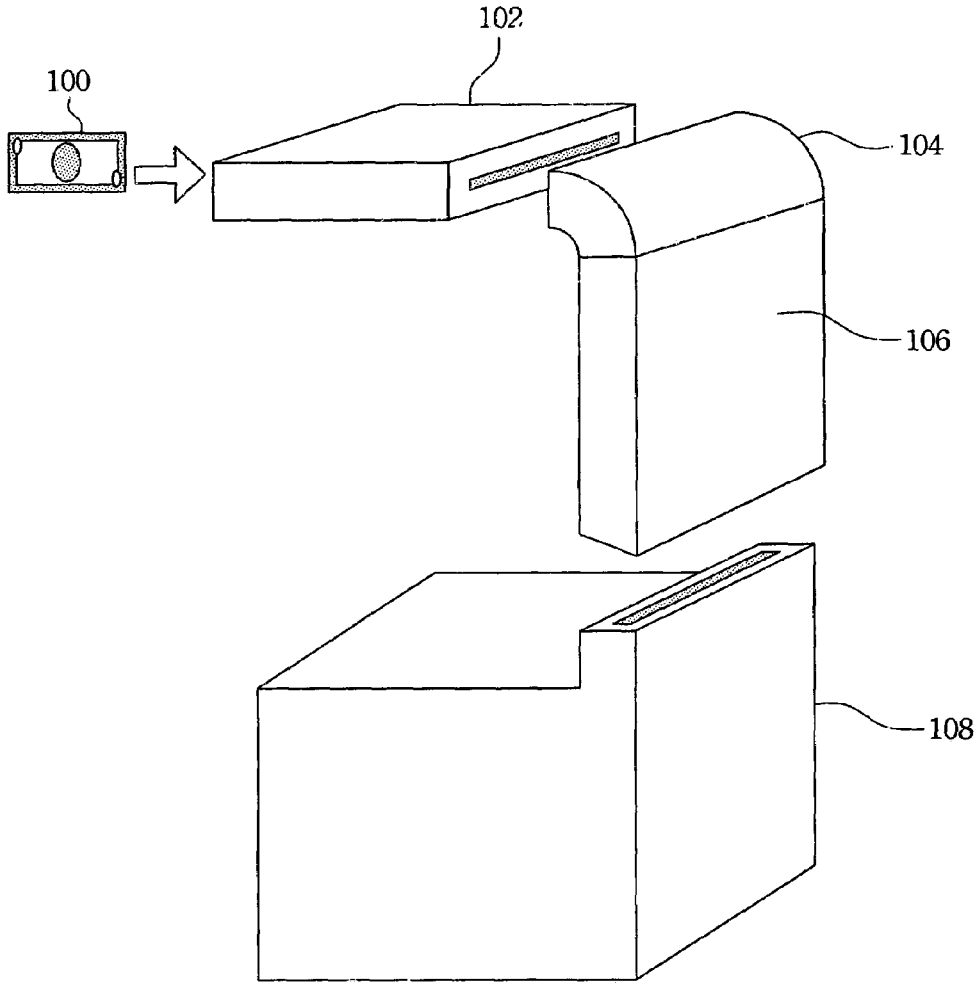
Fig. 1 (PRIOR ART)
FIG. 1 is a schematic diagram of a conventional money exchange apparatus.

This extraction prevention apparatus 200 can be used in any money exchange apparatus. For example, this apparatus can be set between the optical detecting apparatus 106 and the storage box 108 of FIG. 1. Therefore, any bill, before entering the storage box 108, has to pass through the extraction prevention apparatus 200. The bill, after passing through the apparatus 200, makes a "U" turn. Therefore, any line adhered to the bill is wound around the axle. Additionally, the bump resists removal of the line from the axle 214.

As is understood by a person skilled in the art, the foregoing preferred embodiments of the present invention are illustrative of the present invention rather than limiting of the present invention. It is intended that this description cover various modifications and similar arrangements included within the spirit and scope of the appended claims, the scope of which should be accorded the broadest interpretation so as to encompass all such modifications and similar structure.

What is claimed is:

1. A apparatus for avoiding extraction of a bill, said apparatus comprising:

a main roller, wherein said main roller includes an axle and a plurality of round boards, said axle passing through centers of said round boards, and wherein a bump extends from part of a surface of each round board;

a lead board located beside said main roller, wherein a first channel is formed between said main roller and said lead board;

an auxiliary roller located parallel to said main roller, wherein a second channel is formed between said main roller and said auxiliary roller; and first and second supporters, wherein said main roller, said lead board and said auxiliary are located between said first and second supporters.

2. The apparatus of claim 1, further comprising a protection board located beside said main roller.

3. The apparatus of claim 1, wherein said main roller and said auxiliary roller rotate in opposite directions.

4. A bill exchange apparatus, said apparatus comprising:

a detection apparatus for receiving a bill and determining whether said bill is real or counterfeit;

an extraction prevention apparatus coupled with said detection apparatus for receiving a bill determined to be real by said detection apparatus, wherein said extraction prevention apparatus comprises:

a main roller, wherein said main roller includes an axle and a plurality of round boards, said axle passing through centers of the round boards, and wherein a bump extends from part of a surface of each round board;

a lead board, located beside said main roller, wherein a first channel is formed between said main roller and said lead board;

an auxiliary roller, located parallel to said main roller, wherein a second channel is formed between said main roller and said auxiliary roller; and first and second supporters, wherein said main roller, said lead board and said auxiliary are located between said first and second supporter; and a storage box coupled to said extraction prevention apparatus for storing bills passing through said extraction prevention apparatus.

5. The apparatus of claim 4, further comprising a protection board located beside said main roller.

6. The apparatus of claim 4, wherein said main roller and said auxiliary roller rotate in opposite directions.

* * * * *